United States Patent [19]

Genakis

[11] 4,078,406

[45] * Mar. 14, 1978

[54] PIN TUMBLER LOCK WITH ANTI-IMPRESSIONING FEATURE

[75] Inventor: Joseph M. Genakis, Worcester, Mass.

[73] Assignee: Benjamin D. Pollack, Morris, Conn.

[ * ] Notice: The portion of the term of this patent subsequent to Jan. 17, 1995, has been disclaimed.

[21] Appl. No.: 726,207

[22] Filed: Sep. 24, 1976

[51] Int. Cl.[2] ..... E05B 9/04; E05B 15/14

[52] U.S. Cl. ..... 70/364 A; 70/378; 70/373; 70/419

[58] Field of Search ..... 70/364 A, 373, 375, 70/378, 419, 421, 455

[56] References Cited

U.S. PATENT DOCUMENTS

| | | | |
|---|---|---|---|
| 899,955 | 9/1908 | Collins | 70/373 |
| 2,294,495 | 9/1942 | Woodruff | 70/364 A |
| 3,705,508 | 12/1972 | Fritsch | 70/373 |

FOREIGN PATENT DOCUMENTS

| | | | |
|---|---|---|---|
| 572,257 | 11/1958 | Belgium | 70/364 A |

*Primary Examiner*—Robert L. Wolfe
*Attorney, Agent, or Firm*—John E. Toupal

[57] ABSTRACT

A pin tumbler cylinder lock having a plug eccentrically positioned within a cylindrical bore of a housing. Surrounding the plug are longitudinally aligned sleeve segments that together therewith form a composite plug unit that can be rotated in the housing bore by a proper key. Formed on the outer surface of each sleeve segment coincident with pinways therein are recesses that are spaced from the recesses in adjacent sleeve segments. Additional internal recesses are formed in the inner surface of at least one of the sleeve segments closely adjacent a pinway extending therethrough. The internal recesses receive the tumbler pin when it is forced upwardly simultaneously with the application of torque on the plug. In one embodiment, the internal recess is a single recess coincident with the pinway and extending circumferentially therefrom. In another embodiment, the internal recess comprises a pair of recesses located on opposite sides of the pinway and spaced circumferentially therefrom.

7 Claims, 25 Drawing Figures

PIN TUMBLER LOCK WITH ANTI-IMPRESSIONING FEATURE

BACKGROUND OF THE INVENTION

This invention relates generally to cylinder locks and, more specifically, to pin tumbler cylinder locks.

Pin tumbler cylinder locks are used extensively in a wide variety of security application. One such lock is disclosed in the applicant's co-pending U.S. application Ser. No. 706,935. The lock disclosed in that application includes a plug eccentrically mounted in a cylindrical housing and enclosed by a plurality of longitudinally aligned sleeve segments. The plug and sleeve segments together form a composite concentric plug unit that can be turned with a proper key which brings driver and tumbler pins to shear at the intersection between the sleeve segments and the cylindrical housing. The sleeve segments are provided with recesses that encompass the pinways and form false shear levels that help subvert picking of the lock. Although highly resistant to picking, the lock described in the above-noted application does exhibit features that could be detrimental under certain circumstances. For example, after managing to ledge all driver pins on recess surfaces of the sleeve segments, one could possibly breach security of the lock by pulling the plug directly out of the cylinder housing. Also under highly unusual circumstances the lock might be violated by the use of a procedure related to the well-known technique of impressioning.

The object of this invention, therefore, is to provide an improved, pick-resistant pin tumbler cylinder lock.

SUMMARY OF THE INVENTION

The invention is a pin tumbler cylinder lock having a plug eccentrically positioned within a cylindrical bore of a housing. Surrounding the plug are longitudinally aligned sleeve segments that together therewith form a composite plug unit that can be rotated in the housing bore by a proper key. Formed on the outer surface of each sleeve segment coincident with pinways therein are recesses that are spaced from the recesses in adjacent sleeve segments. Additional internal recesses are formed in the inner surface of at least one of the sleeve segments closely adjacent a pinway extending therethrough. The internal recesses receive the tumbler pin when it is forced upwardly simultaneously with the application of torque on the plug. For this reason one employing this procedure in an attempt to determine the length of the tumbler pin derives ambiguous information. In one embodiment, the internal recess is a single recess coincident with the pinway and extending circumferentially therefrom. In another embodiment, the internal recess comprises a pair of recesses located on opposite sides of the pinway and spaced circumferentially therefrom. The latter embodiment has the advantage of not reducing further the wall thickness of the sleeve in the direct proximity of the pinway.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENTS

Figure 1:
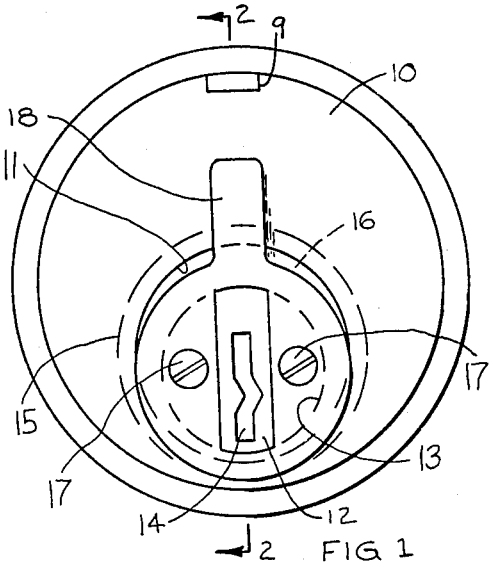
FIG. 1 is a view in rear elevation of the lock.

Referring now to FIGS. 1–6, a lock according to the invention includes a housing 10 with a spring retaining slide piece 9. Extending through the housing 10 is a circularly cylindrical longitudinal bore 11 that retains a composite sleeve 16 formed by longitudinally aligned sleeve segments **16*a* and 16*b* rotatable with respect to each other. The sleeve 16 defines a cylindrical passage 13 with a central axis that is eccentric to the axis of the bore 11. Retained within the passage 13 is a cylindrical plug 12 having a longitudinal keyway 14 and a circular flanged face 15 that is accommodated by a circular opening in the housing 10 and has a center coincident with the axis of the bore 11. A latching cam 18 is attached to the rear end of the plug 12 by a pair of set screws 17**.

Figure 6:
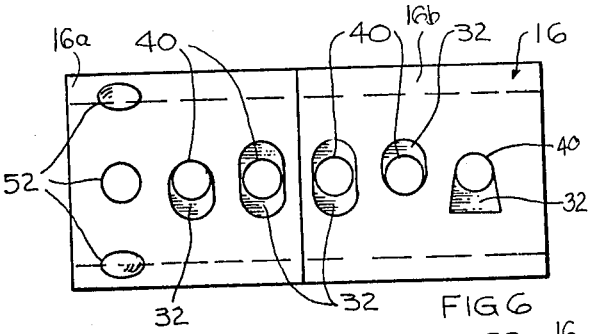
FIG. 6 is a view in elevation looking in the direction of arrow 6 in FIG. 5.

The plug 12 also defines a plurality of transverse pinways 20 that extend into the keyway 14 and retain conventional tumbler pins 22. Normally aligned with the plug pinways 20 are pinways 24 defined by the housing 10 and retaining conventional driver pins 26. Springs 27 in the housing 10 bias the driver pins 26 and engaged tumbler pins 20 inwardly. Aligned between the plug pinways 20 and the housing pinways 24 are pinways 40 that extend through the sleeve 16 and accommodate both the tumbler pins 22 and the driver pins 26. Each of the sleeve segments 16*a* and 16*b* possesses discontinuous, spaced apart external recesses 32 that encompass the sleeve pinways 40. As shown in FIG. 6, the external recesses 32 can be provided with any of a variety of different shapes all of which provide bottom surfaces extending circumferentially from the pinways 40.

During use of the lock, a proper key inserted into the keyway 14 forces the pins 22 and 26 outwardly into positions wherein their planes of intersection coincide with a shear level defined by the engaging surfaces of the housing 10 and the sleeve 16. In those positions the driver pins 26 are out of engagement with the sleeve 16 while the tumbler pins 22 tie together the sleeve 16 and the plug 12 allowing them to rotate as a composite unit on the axis of the longitudinal bore 11. During this operation the plug 12 moves in an orbital path about the axis of the longitudinal bore 11. This in turn produces rotation of the cam 18 in either a locking or unlocking direction. However, in the absence of a proper key, the driver pins 26 prevent rotation of the sleeve 16 and independent rotation of the plug 12 is prevented by its eccentricity. Furthermore, the external recesses 32 on the sleeve segments 16*a* and 16*b* establish false shear levels that complicate attempts to pick the lock. Further details regarding the functions of the plug 12 and sleeve 16 in establishing lock security are disclosed in the above-noted U.S. application Ser. No. 706,935.

Figure 2:
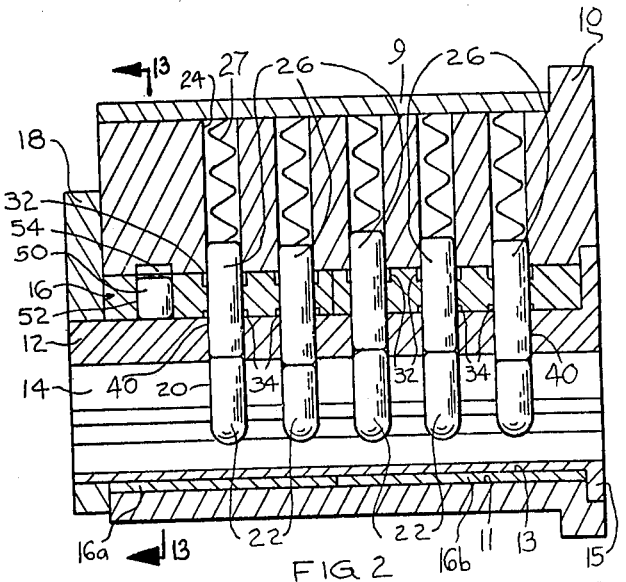
FIG. 2 is a section taken on line 2—2 of FIG. 1.
Figure 3:
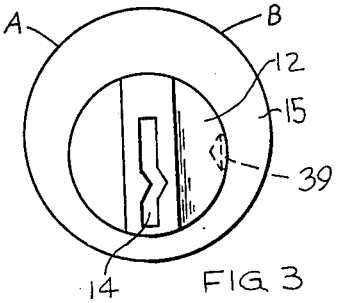
FIG. 3 is a rear view of the lock's plug showing its keyway and an eccentric plug face.
Figure 5:
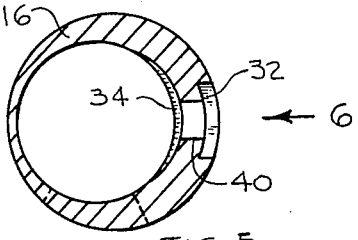
FIG. 5 is a sectional view through a sleeve shown in FIG. 2.
Figure 7:
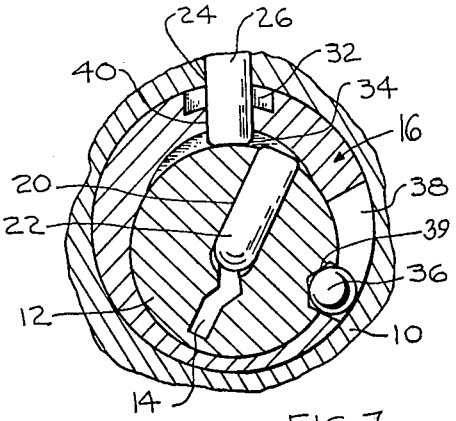
FIG. 7 is a sectional view illustrating an action of the pins during a picking attempt.
Figure 10:
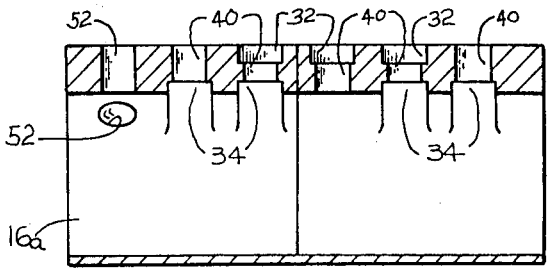
FIG. 10 is a section taken on line 10—10 of FIG. 9.
Figure 11:
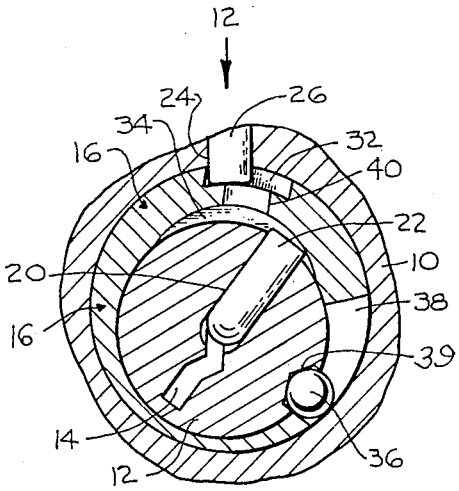
FIG. 11 is a section similar to FIG. 7 but showing the pins in a different relationship.

The internal surfaces of the sleeve segments 16*a* and 16*b* also define recesses 34 as illustrated in FIGS. 2 and 5. The internal recesses 34 function to prevent breach of the lock's security by producers related to the well-known impressioning technique. Obviously, one knowing the length of each of the tumbler pins 22 could determine the amount of pin movement required to establish shear and having that information could cut a key that would establish proper shear and permit opening of the lock. To obtain such information a picker would attempt to sequentially measure the length of movement required to force each tumbler pin 22 into engagement with the inner surface of the sleeve 16. This could be done either by rotating the plug 12 until a tumbler pin 22 is out of engagement with its associated driver pin 26 as illustrated in FIG. 7 or by first ledging a driver pin 26 in an external recess 32 and then forcing the associated tumbler pin 22 against the inner surface of the sleeve 16 as shown in FIG. 11. However, a tumbler pin 20 would enter the internal recess 34 before engaging the sleeve 16 thereby experiencing greater movement than would occur in the absence of the internal recess 34. Furthermore, since internal recesses 34 would not be provided adjacent each sleeve pinway 40, but only adjacent to coded ones thereof as shown in FIG. 10, the picker would be unable to determine which tumbler pins were engaging the inner surface of the sleeve 16 and which were engaging the surface of an internal recess 34. Thus, the exact lengths of each of the tumbler pins 22 could not be established by this technique.

Figure 4:
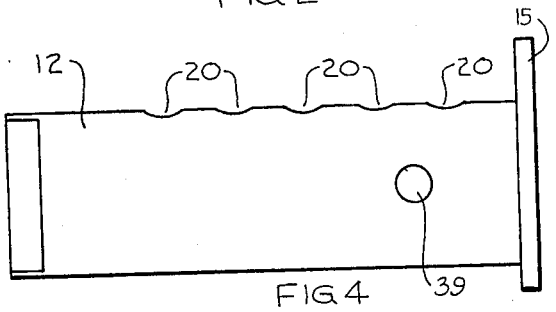
FIG. 4 is a view in side elevation of the plug.
Figure 8:
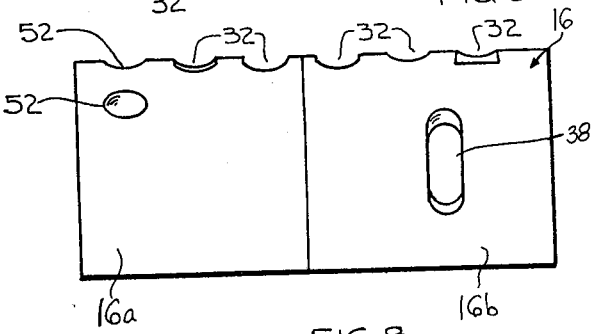
FIG. 8 is a view in side elevation of the sleeve segments shown in FIG. 6.
Figure 9:
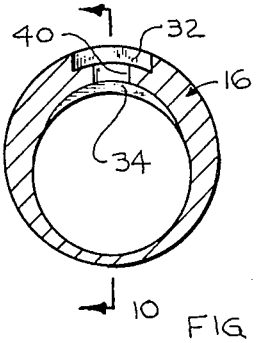
FIG. 9 is a sectional view in an upright position of the sleeve shown in FIG. 5.
Figure 12:
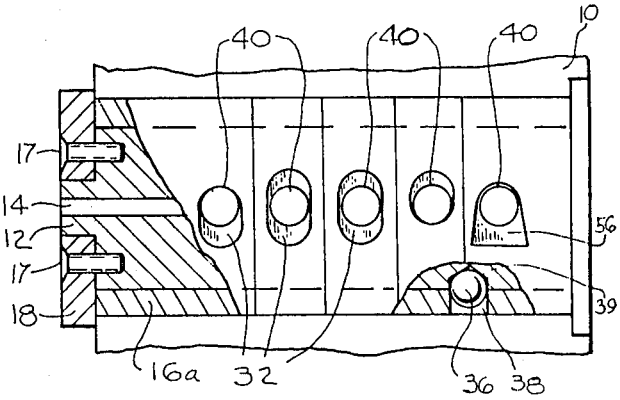
FIG. 12 is a view in top plan partly in section looking in the direction of arrow 12 in FIG. 11.

FIGS. 7, 8, 11 and 12 illustrate structure for preventing the plug 12 from being forcibly withdrawn in an axial direction from the sleeve 16 and housing 10. Assuming that a picker were able to move all of the driver pins 26 out of the plug pinways 20 by, for example, ledging them as shown in FIG. 11, the plug 12 would be retained in the housing 10 only by the set screws 17. Thus a suitable pulling tool could be employed to forcibly withdraw the plug 12 and thereby breach the lock's security. To prevent such an occurrence, the sleeve 16*b* is provided with an elongated slot 33 as shown in FIGS. 7 and 8 and the plug 12 is provided with an aligned depression 39 as shown in FIGS. 4 and 7. Occupying the hollow region provided by the slot 38 and depression 39 is a ball 36 as shown in FIGS. 7 and 12.

Figure 14:
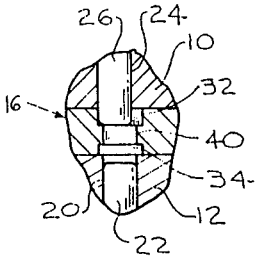
FIG. 14 is a transverse partial section showing the action of the top pins resisting forced removal of the sleeve from the cylinder housing.

During attempts to pick the lock by applying torque to the plug 12, the ball 36 moves freely within the slot 38 thereby allowing relative rotational movement between the sleeve 16 and the plug 12. However, in response to any attempt to produce longitudinal movement of the plug 12 relative to the sleeve 16, the ball 36 engages the side walls of the slot 38 thereby keying together the plug 12 and the sleeve 16. Thus, axial removal of the plug 12 is prevented. In this regard it will be noted that axial removal of the plug 12 and the sleeve 16 as a composite unit is prevented by the discontinuous nature of the outer recesses 32 even when all of the driver pins 26 have been ledged in the recesses 32. FIG. 14 illustrates the manner in which a driver pin 26 ledged in an external recess 32 engages the side wall thereof to prevent axial removal of a keyed together plug and sleeve.

Figure 13:
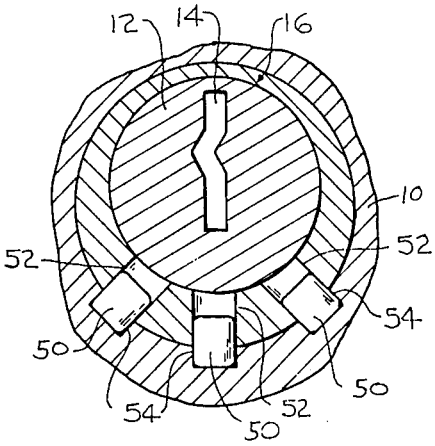
FIG. 13 is a section taken on line 13—13 of FIG. 2 and shifted 180°.

As described in above-noted U.S. application Ser. No. 706,935, picking of the lock is made more difficult by the tendency of the tumbler pins 22 to be pulled by gravity back into the plug 12 after upward pressure and torque are eliminated. This advantage would be lost in applications wherein a picker could orient the lock in the inverted position shown in FIG. 13 since gravity could not then pull the tumbler pins 22 back into the plug 12. This problem is obviated in the present invention as shown in FIGS. 2, 6, 8, 10 and 13. The sleeve 16*a* is provided with three circumferentially separated holes 52 that are aligned with openings 54 in the housing 10. Disposed within the holes 52 are latching pins 50. During normal use of the lock, the latching pins 50 lie entirely within the holes 52 in the sleeve segment 16*a* and therefore do not interfere with lock operation. However, upon a 180° re-orientation of the entire lock as depicted in FIG. 13, the latch pins 50 extend also into the openings 54 in the housing 10. With the latching pins 50 thusly engaged, opening of the lock is prevented regardless of the positions occupied by the tumbler pins 22 and the driver pins 26.

Figure 15:
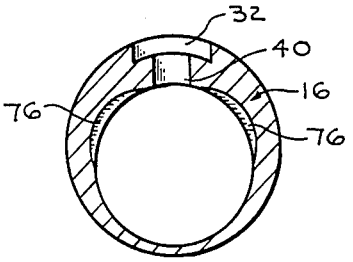
FIG. 15 is a view similar to FIG. 9 but showing a modified sleeve.

FIG. 15 shows another embodiment of the invention utilizing modified internal recesses 76. In this case, the single internal recess 34 coincident with the sleeve pinway 40 is replaced by a pair of recesses 76 located on opposite sides thereof in the direction of plug rotation. The recesses 76 function in the same manner as described above in connection with the single recess 34. They have the advantage, however, of being non-coincidental with the pinway 40 and thereby do not further reduce the wall thickness of the sleeve at that point.

Figure 16:
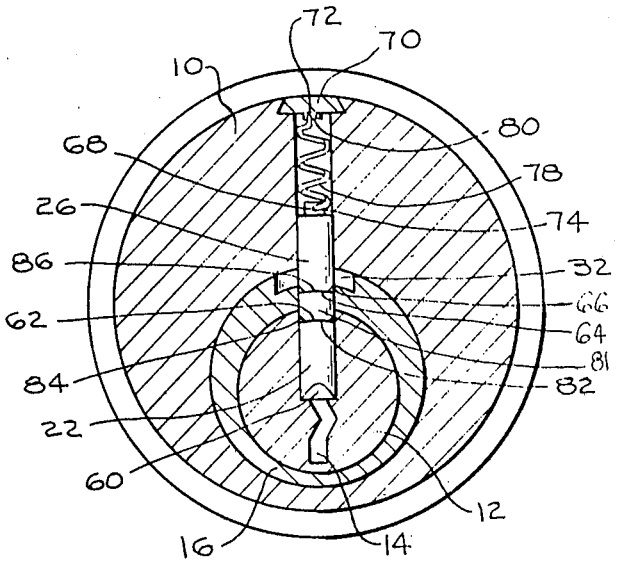
FIG. 16 is a section through the lock but showing modified pins.
Figure 17:
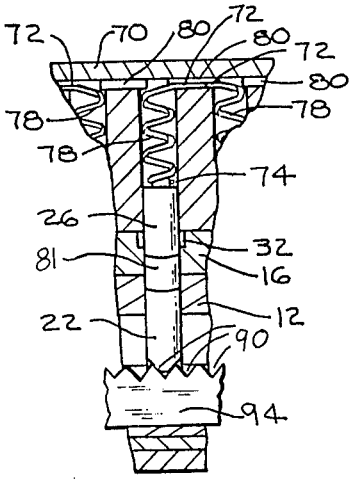
FIG. 17 is a section showing the pins of FIG. 16 at right angles thereto.
Figure 18:
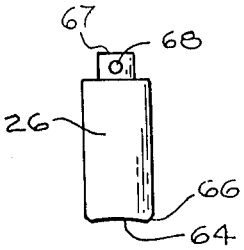
FIG. 18 is a view in elevation of the driver pin shown in FIGS. 16 and 17.
Figure 19:
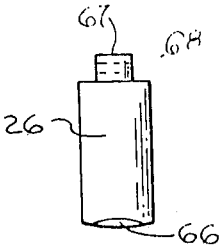
FIG. 19 is a side view thereof.
Figure 20:
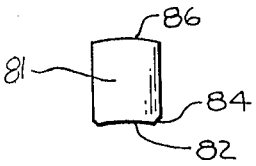
FIG. 20 is a view in elevation of the master pin shown in FIGS. 16 and 17.
Figure 21:
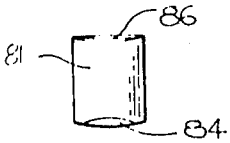
FIG. 21 is a side view thereof.
Figure 24:
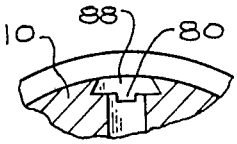
FIG. 24 is a partial transverse section showing a coupling for the driver pin spring shown in FIGS. 16 and 17.
Figure 22:
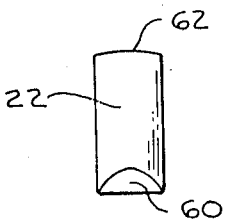
FIG. 22 is a view in elevation of the tumbler pin shown in FIGS. 16 and 17.
Figure 23:
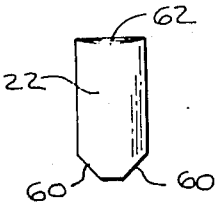
FIG. 23 is a side view thereof.

FIGS. 16–24 illustrate modified pins for use in the lock shown in FIGS. 1–15. Components identical to those shown in FIGS. 1–14 bear the same reference numerals in FIGS. 16–24. As shown most clearly in FIGS. 22 and 23, the upper end of a tumbler pin 22 is provided with a convex cylindrical surface 62 and its lower end is in the form of a wedge with downwardly converging planar surfaces 60. A driver pin 26, as shown in FIGS. 18 and 19 has a lower end formed by a concave cylindrical surface 64, the outer edges of which are joined to the outer walls of the pin 26 by slanted planar surfaces 66. Extending from the top of the driver pin 26 is a coupling ear 67 having an aperture 68. As shown in FIGS. 16 and 17, an end 74 of a coiled spring 78 extends through the aperture 68 in the ear 67. The opposite end 72 of the spring 78 extends into a longitudinal slot 80 formed in the housing 10 and shown most clearly in FIGS. 17 and 24. Communicating with the longitudinal slot 80 is a longitudinally extending, trapezoidally shaped recess 88 that receives a similarly shaped retainer rod 70 shown in FIGS. 16 and 17. Positioned between the tumbler pin 22 and the driver pin 26 is a master pin 81 shown most clearly in FIGS. 20 and 21. The bottom end of the master pin 81 has a concave cylindrical surface 82 the outer edges of which are joined to the side walls of the pin by slanted planar surfaces 84. The upper end of the master pin 81 is a convex cylindrical surface 86.

The complementary surfaces 62 and 82 of the tumbler pin 22 and master pin 81, respectively, have identical curvatures so as to establish a conforming engagement therebetween. Similarly, the compatible surfaces 64 and 86 of the driver pin 26 and master pin 81, respectively, have identical curvatures so as to establish a conforming engagement. Furthermore, the cylindrical curvatures on each of the surfaces 62, 64, 82 and 86 are identical to the outer curvature of the cylindrical sleeve 16 which as noted above forms with the plug 12 a composite unitary plug unit during operation of the lock.

Figure 25:
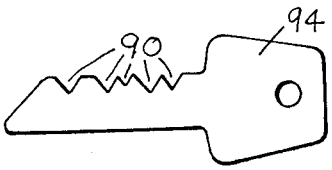
FIG. 25 illustrates a key used with the pins of FIGS. 16–23.

The spring member 78 having one end 72 retained in the slot 80 and the opposite end 74 coupled to the ear 67 retains the master pin 26 in an orientation wherein the cylindrical surface 64 is parallel to the outer surface of the sleeve 16. Similarly, the tumbler pin 22 is biased by a suitably cut key 94, shown in FIG. 25, into an orientation wherein its upper surface 62 is parallel to the outer surface of the sleeve 16. The key 94 is provided with V-shaped cuts 90 that conform to the wedge-shaped surfaces 60 on the tumbler pin 22. Thus, upon insertion of the key 94 the conforming surfaces 60 on the pins 22 and those on the cuts 90 align the pins 22 into the desired orientation. Because of the conforming surfaces 64, 86 and 62, 82, the master pins 81 also are cammed into positions wherein the surfaces 82 and 86 are parallel to the outer surface of the sleeve 16. It will be obvious that this camming operation could also be used to properly orient the driver pin 26 thereby eliminating the need for the orientation bias provided by tying the coiled spring to the coupling ears 67.

Because of the aligned and conforming surfaces on the pins 22, 26 and 81 and the sleeve 16, operation of the lock is extremely smooth when either of the mating pin surfaces 64 and 86 or 62 and 82 are brought to shear level at the intersection between the housing 10 and the sleeve 16. Furthermore it will be noted that the smooth operation is obtained without the use of excessively tapered or spherical surfaces on the pins which types of surface greatly reduce the lock's sensitivity to a specific shear level. Thus, the pins shown in FIGS. 16–24 can accommodate a greater number of distinguishable cuts than can the spherical or tapered pins conventionally used to provide smooth operation.

Obviously, many modifications and variations of the present invention are possible in light of the above teachings. It is to be understood, therefore, that the invention can be practiced otherwise than as specifically described.

What is claimed is:

1. A cylinder lock comprising:

a lock housing defining a circularly cylindrical bore and a plurality of housing pinways;

a circularly cylindrical sleeve means rotatably mounted in said bore and having a circularly cylindrical passage with a central axis eccentric to the axis of said bore, said sleeve means defining a plurality of sleeve pinways aligned with said housing pinways and said passage having internal recess means disposed closely adjacent to at least one of said sleeve pinways;

a cylindrical plug rotatably mounted in said passage and defining a longitudinally extending keyway, said plug further defining a plurality of transversely extending plug pinways intersecting said keyway and aligned with said sleeve pinways;

a plurality of stacked pins longitudinally movable within each set of said aligned housing, sleeve and plug pinways;

bias means forcing said stacked pins toward said keyway; and rotational coupling means limiting rotation of said plug within said passage so as to limit lock opening movement of said plug to an orbital path about the axis of said bore.

2. A cylinder lock according to claim 1 wherein said recess means comprises a recess coincident with said one sleeve pinway and extending circumferentially in both directions therefrom.

3. A cylinder lock according to claim 2 including external recesses on the outer surface of said sleeve means, each coincident with a different one of said sleeve pinways and extending circumferentially therefrom.

4. A cylinder lock according to claim 3 wherein said sleeve means comprise a plurality of longitudinally aligned, independently rotatable sleeve segments, each retaining at least one of said sleeve pinways.

5. A cylinder lock according to claim 1 wherein said recess means comprises a pair of recesses disposed on opposite sides of said one sleeve pinway and spaced circumferentially therefrom.

6. A cylinder lock according to claim 5 including external recesses on the outer surface of said sleeve means, each coincident with a different one of said sleeve pinways and extending circumferentially therefrom.

7. A cylinder lock according to claim 6 wherein said sleeve means comprise a plurality of longitudinally aligned, independently rotatable sleeve segments, each retaining at least one of said sleeve pinways.

* * * * *